US007097289B2

(12) United States Patent
Bybee et al.

(10) Patent No.: US 7,097,289 B2
(45) Date of Patent: Aug. 29, 2006

(54) INK DELIVERY APPARATUS WITH PRESSURE TUNED ROLLING PISTON AND METHOD OF USE

(75) Inventors: Cary R. Bybee, Lebanon, OR (US); Anthony D. Studer, Albany, OR (US); David J. Benson, Albany, OR (US); Kevin D. Almen, Albany, OR (US); Bob Wickwire, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 140 days.

(21) Appl. No.: 10/660,941

(22) Filed: Sep. 12, 2003

(65) Prior Publication Data

US 2005/0057617 A1 Mar. 17, 2005

(51) Int. Cl.
*B41J 2/175* (2006.01)

(52) U.S. Cl. ..... 347/85

(58) Field of Classification Search ..... 347/85, 347/86, 87; 141/2, 18
See application file for complete search history.

(56) References Cited

U.S. PATENT DOCUMENTS

| | | | | |
|---|---|---|---|---|
| 3,939,888 | A * | 2/1976 | Scarnato | 220/666 |
| 4,162,501 | A * | 7/1979 | Mitchell et al. | 347/86 |
| 4,992,802 | A * | 2/1991 | Dion et al. | 347/87 |
| 5,136,309 | A * | 8/1992 | Iida et al. | 347/7 |
| 5,187,498 | A * | 2/1993 | Burger | 347/86 |
| 5,473,354 | A | 12/1995 | Arquilevich et al. | |
| 5,608,437 | A * | 3/1997 | Iwata et al. | 347/86 |
| 6,386,693 | B1 * | 5/2002 | Michele et al. | 347/86 |
| 6,428,152 | B1 * | 8/2002 | Hollands | 347/85 |
| 6,431,694 | B1 * | 8/2002 | Ross | 347/74 |
| 6,478,415 | B1 * | 11/2002 | Barinaga et al. | 347/85 |
| 6,561,635 | B1 | 5/2003 | Wen | |
| 6,783,215 | B1 * | 8/2004 | Yoshida et al. | 347/85 |
| 6,824,139 | B1 * | 11/2004 | Barinaga et al. | 277/628 |
| 6,824,256 | B1 * | 11/2004 | Thielman et al. | 347/85 |
| 6,908,180 | B1 * | 6/2005 | Dietl | 347/85 |

* cited by examiner

*Primary Examiner*—Anh T. N. Vo

(57) ABSTRACT

An ink delivery apparatus includes a pressure tuned rolling piston having a distal end. The distal end includes a pressure responsive portion. A first convolute portion supports the pressure responsive portion, and the first convolute portion is configured to provide a first level of resistance against a negative pressure.

23 Claims, 6 Drawing Sheets

INK DELIVERY APPARATUS WITH PRESSURE TUNED ROLLING PISTON AND METHOD OF USE

BACKGROUND

A typical thermal inkjet has an array of precisely formed nozzles attached to a print head substrate corresponding to an array of firing chambers that receive liquid ink from a reservoir. Each firing chamber may include a thin-film resistor or firing resistor located opposite the nozzle to allow for the presence of ink between the firing resistor and the nozzle. Electric pulses may then be applied to heat the firing resistors to cause a small portion of the ink near the firing resistor to vaporize. The pressure created by this vaporization drives a small amount of ink through the nozzle. The nozzles may be arranged in a matrix array. Properly sequencing the operation of each nozzle in the array causes characters and/or images to form as the print head is moved with respect to a print medium, such as a piece of paper.

Efforts have been made to reduce the cost and size of ink-jet printers and to reduce the cost per printed page. Some of these efforts have focused on developing printers having small, moving print heads that are connected to larger stationary ink reservoirs by flexible ink tubes. This configuration is commonly referred to as "off-axis" printing.

The development of off-axis printing has created the need to precisely control the pressure of the ink at a variety of locations including the ink reservoir and the print head. Print cartridges may have an internal pressure regulator for regulating the flow of ink from an external source into an ink chamber within the print cartridge. Print cartridges with an internal pressure regulator often incorporate a diaphragm in the form of a bag. The inside of the bag is open to the atmosphere. The expansion and contraction of the bag controls the flow of ink into the print cartridge to maintain a relatively constant back pressure at the print head.

However, when too much air has accumulated in the body and/or manifold of the print cartridge, the regulator may no longer have the capacity to maintain negative pressure. At that point, air in the print head may render nonfunctional any pressure regulator internal to, or leading to, the print cartridge. As a result, the desired back pressure may be lost (for example, due to variation in the temperature or pressure of the ambient environment), and ink may drool out of the print head. A drooling print head may cause permanent damage to the printer and will likely be unable to print with an acceptable print quality.

Designs utilizing a separate pressure regulator to address these issues may be relatively complicated. In addition, the use of a separate pressure regulator may limit the operating efficiency of the printing device. Accordingly, recent efforts have been directed to providing a less complicated ink supply system that is able to reliably provide back pressure. Some designs utilize foam placed in the ink supply. As the ink supply is drained, the volume of the ink supply tends to decrease. The foam placed in the ink supply tends to resist the decrease in volume. As a result of this resistance, a suitable back pressure may be created. Similarly, other designs utilize a spring placed in an ink bag. However, with these designs, a significant amount of the ink in the supply may be stranded and therefore wasted. Such waste may require more frequent ink re-supply, thereby increasing the operating cost of the system.

SUMMARY

An ink delivery apparatus includes a pressure tuned rolling piston having a distal end. The distal end includes a pressure responsive portion. A first convolute portion supports the pressure responsive portion, and the first convolute portion is configured to provide a first level of resistance against a negative pressure.

BRIEF DESCRIPTION OF THE DRAWINGS

The accompanying drawings illustrate various embodiments of the present apparatus and method and are a part of the specification. The illustrated embodiments are merely examples of the present apparatus and method and do not limit the scope of the disclosure.

Throughout the drawings, identical reference numbers designate similar, but not necessarily identical, elements.

DETAILED DESCRIPTION

An ink delivery apparatus and method of use are described herein. As used herein and in the appended claims, the term "ink" shall refer broadly to any ink, toner, colorant or other marking fluid ejected by a print head. According to one exemplary embodiment described below, an ink delivery apparatus includes a pressure tuned rolling piston having a distal end. The distal end includes a pressure responsive portion. A first convolute portion is coupled to the pressure responsive portion, and the first convolute portion is configured to provide a first level of resistance against a negative pressure.

In the following description, for purposes of explanation, numerous specific details are set forth in order to provide a thorough understanding of the present apparatus and method. It will be apparent, however, to one skilled in the art that the present apparatus and method may be practiced without these specific details. Reference in the specification to "one embodiment" or "an embodiment" means that a particular feature, structure, or characteristic described in connection with the embodiment is included in at least one embodiment. The appearance of the phrase "in one embodiment" in various places in the specification are not necessarily all referring to the same embodiment.

Exemplary Structure

Figure 1:
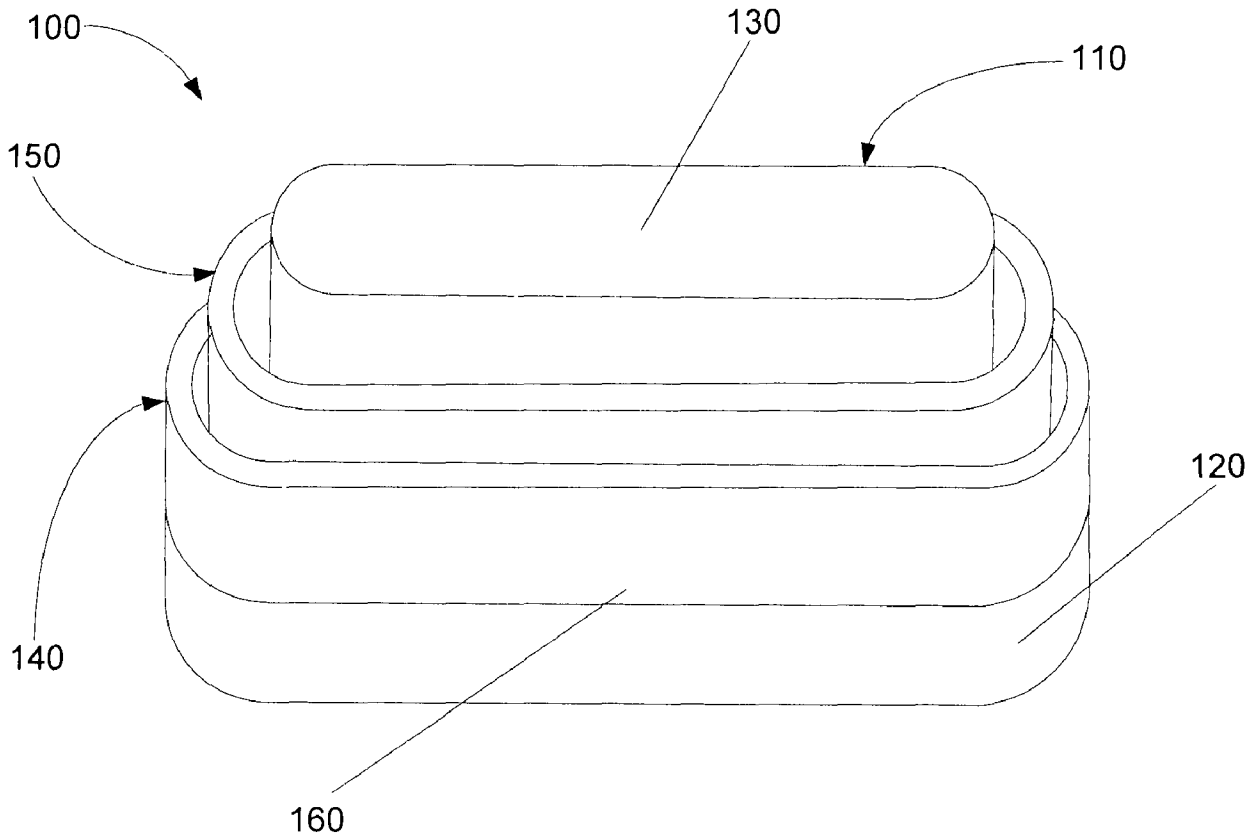
FIG. 1 illustrates a perspective view of a ink delivery apparatus having a rolling piston according to one exemplary embodiment.

FIG. 1 illustrates an ink delivery apparatus (100) that generally includes a rolling piston (110) and a fitment (120). The rolling piston includes a generally planar pressure responsive portion (130), a first convolute portion (140), and a second convolute portion (150). As used herein and in the appended claims, a "convolute portion" is a fold or ridge in the piston (110).

The pressure responsive portion (130) provides a surface area on which pressure may act to deflect the rolling piston (110). An example of such a pressure may include a negative pressure established in the rolling piston (110). This negative pressure may act as a force on the pressure responsive portion (130) that urges the pressure responsive portion (130) toward a proximal end (160) of the rolling piston (110).

The convolute portions (140, 150) are configured to provide predetermined levels of resistance to the negative pressure in the piston (110) and the collapse of the pressure response portion (130) toward the proximal end (160) of the piston (110) as the negative pressure increases. More or fewer convolute portions may be provided in any particular application.

Figure 2:
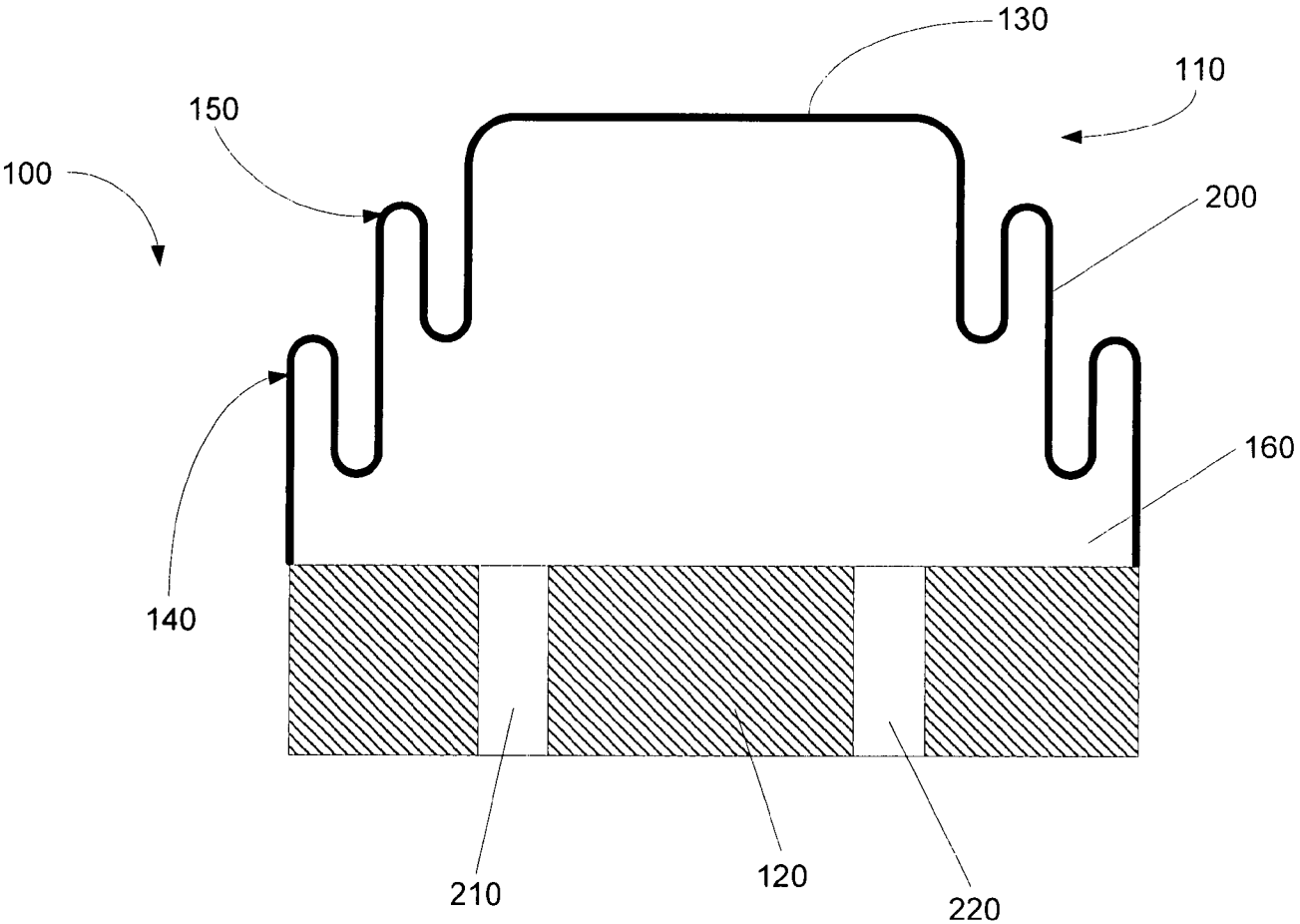
FIG. 2 illustrates a cross sectional view of the ink delivery apparatus of FIG. 1.

As seen in FIG. 2, the rolling piston (110) is sealingly coupled to the fitment (120). Also seen in FIG. 2, the walls (200) of the rolling piston (110) may be of substantially uniform thickness. The first convolute portion (140) may have a first aspect ratio, while the second convolute portion (150) may have a different aspect ratio. Aspect ratio refers to the relationship between the height and width of a convolute portion. For example, the second convolute portion (150) may have a different height and/or width than the first convolute portion (140) in order to provide the predetermined level of resistance to the negative pressure required by the system.

In addition, two fluid interconnects (210, 220) may be located in the fitment (120). The first fluid interconnect (210) may be configured to couple the ink delivery apparatus (100) to a print head. A supply of ink disposed in the piston (110) at a negative pressure is then provided through the first fluid interconnect (210) to the print head for use in printing. The ink delivery apparatus (100) may be used in both off-axis and on-axis printing systems as will be described further below.

The second fluid interconnect (220) is configured to couple the ink delivery apparatus (100) to an external ink source (not shown) during an initial filling of the ink delivery apparatus (110). In some embodiments, however, only one fluid interconnect may be provided in the fitment (120).

Exemplary Implementation and Operation

Figure 3:
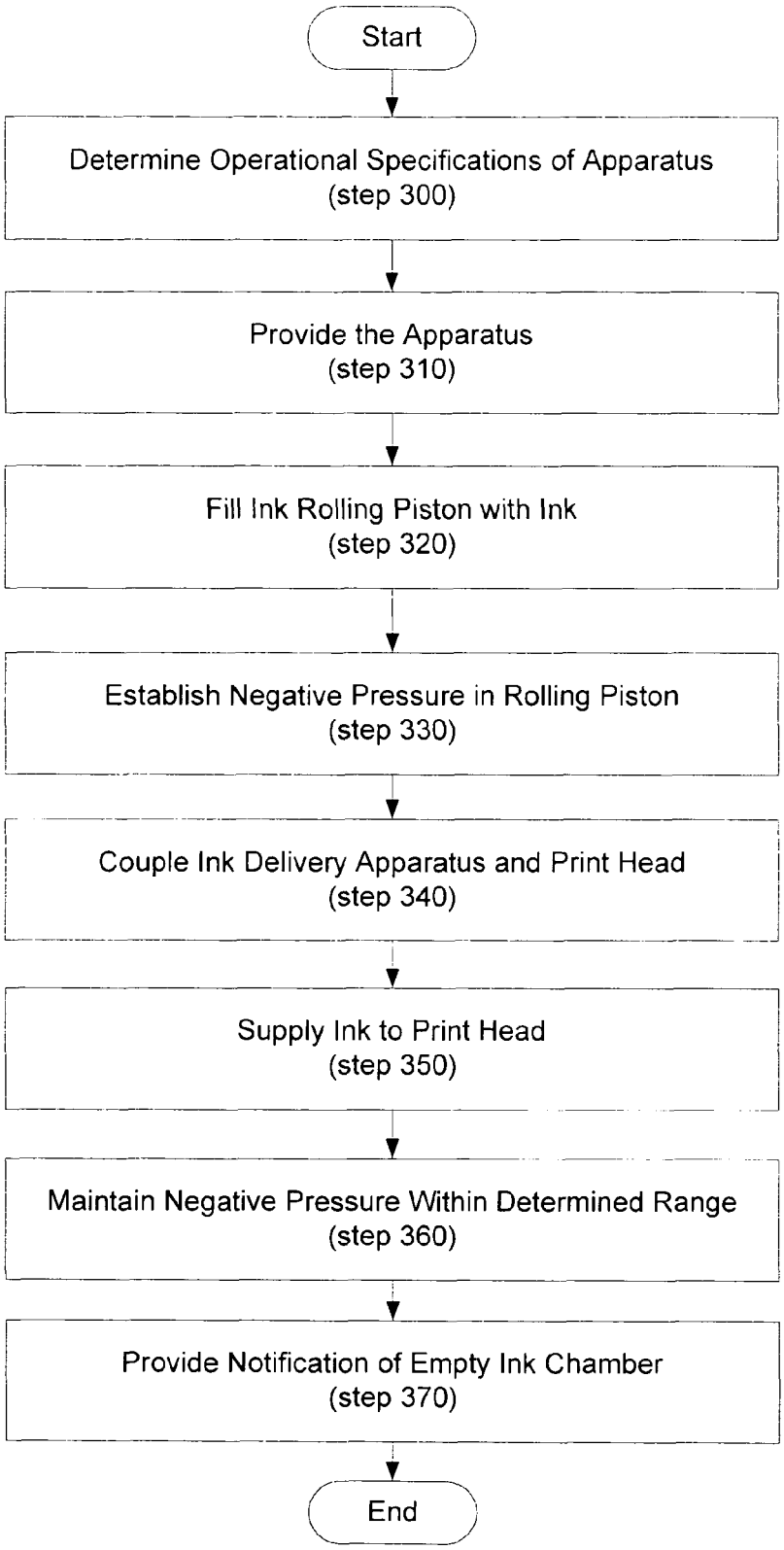
FIG. 3 is a flowchart of a method of using an ink delivery apparatus according to one exemplary embodiment.

FIG. 3 is a flowchart illustrating a process of using the ink delivery apparatus according to the present disclosure. The process begins by determining the operating specifications of the apparatus (300). These operating specifications are based on the characteristics of the printing device with which the ink delivery apparatus is going to be used. These characteristics may include the pressure and ink flow operating specifications of the printing device to provide optimal print quality.

Once the operating specifications of the apparatus have been determined (step 300), the ink delivery apparatus is formed in accordance with those operating specifications (step 310). This includes the formation of a rolling piston, as described above. The convolute portions are formed with aspect ratios that are configured to provide a determined amount of resistance to a range of negative pressures within the piston and that maintain the negative pressure within predetermined limits.

The apparatus is then filled with ink (step 320). Once the apparatus is filled with ink (step 320) a negative pressure is established within the rolling piston (step 330). This is accomplished, for example, by applying a positive pressure to the pressure responsive portion (130, FIG. 1) of the rolling piston while the piston is filled (step 320) and then releasing the positive pressure once the rolling piston is filled with ink. The negative pressure may also be established by removing a small amount of ink from the rolling piston subsequent to filling the rolling piston (step 320).

The ink delivery apparatus is then coupled to a print head (step 340). Once the ink delivery apparatus has been coupled to a print head (step 340), ink is supplied to the print head (step 350).

Supplying ink to the print head (step 350) causes the level of the negative pressure in the rolling piston to increase. It is desirable to maintain the pressure within a predetermined range (step 360) based on the operational specifications determined above. The negative pressure is maintained in the specified range through deflection of the pressure responsive portion as supported by the convolute portions of the piston. The rolling piston deflects in response to the force exerted on the pressure responsive portion due to the negative pressure. Accordingly, the pressure responsive portion is deflected or drawn toward the proximal end of the fitment. The amount of deflection of the pressure responsive portion is related, at least in part, to the aspect ratios of each of the convolute portions of the rolling piston.

As the rolling piston is drained, the first convolute portion unrolls, thereby resiliently resisting the force and maintaining the negative pressure within the determined range. As the pressure becomes increasingly negative, the second convolute portion unrolls, thereby providing further resistance to the force exerted on the pressure responsive portion. In the event of a change in the ambient environment, the pressure responsive portion deflects or is pushed away from the proximal end and/or the convolute portions partially return to their unrolled conditions in response to the change while maintaining the negative pressure within the predetermined limits.

Accordingly, the configuration of the rolling piston allows for maintenance of the negative pressure within predetermined limits while compensating for variations in the ambient environment. This allows the ink delivery apparatus to reliably provide ink to the print head while also minimizing the tendency of the print head to drool.

Once nearly all of the ink has been withdrawn from the rolling piston, the negative pressure may increase sharply. This sharp increase in negative pressure may indicate that the rolling piston is operationally empty. "Operationally empty" refers to the condition in which there is insufficient ink remaining in the piston to provide a reliable supply for printing. There may still be some ink in the piston. Thus, operationally empty does not mean completely empty. Accordingly, the pressure is monitored for a sharp increase in negative pressure indicating that the piston is operationally empty. When such an increase is sensed, a human user or the printer is notified that the rolling piston is operationally empty (step 370).

As can be seen from the above process, the controlled deflection of the rolling piston facilitates maintenance of a negative pressure within predetermined pressure limits as ink is withdrawn from the rolling piston. Such control allows for enhanced printer performance.

Figure 4:
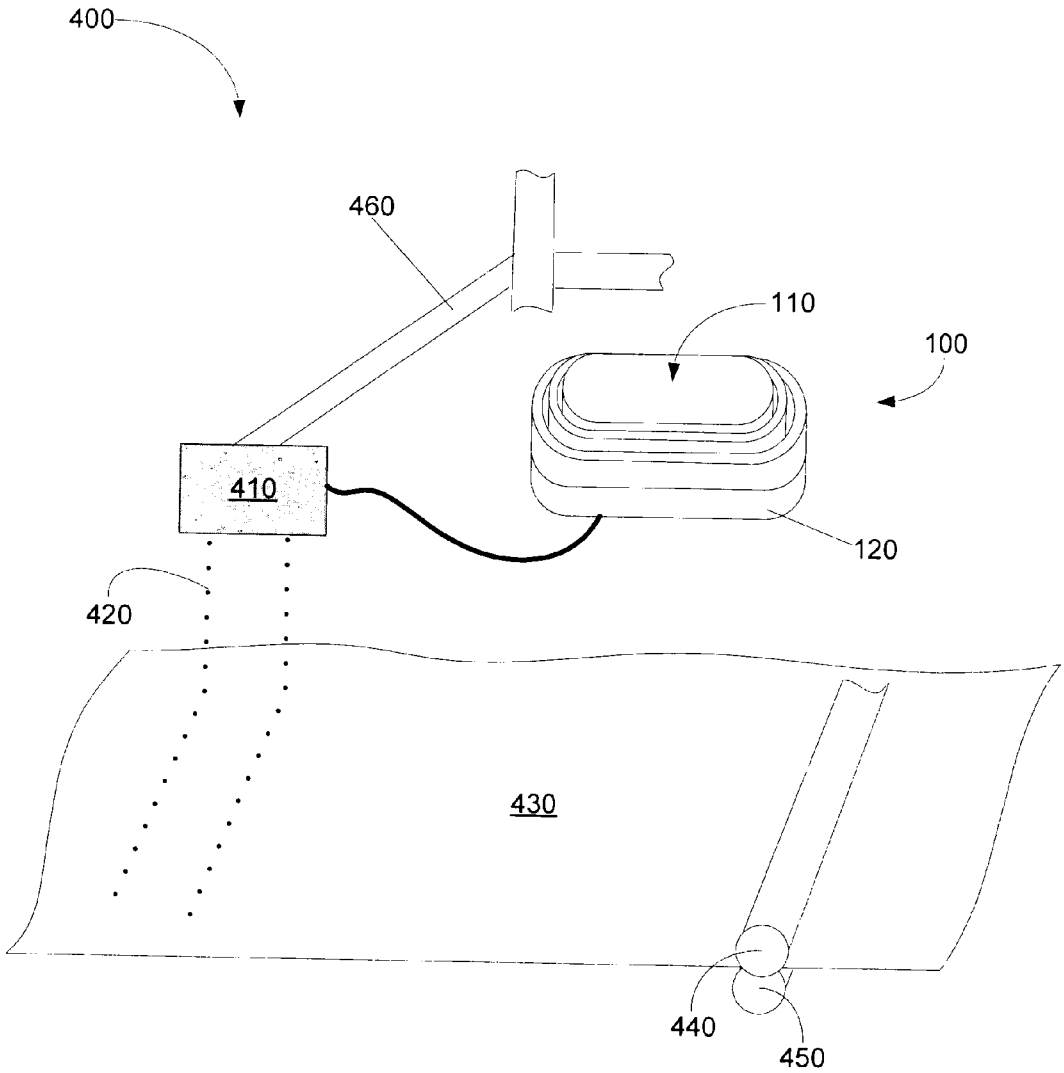
FIG. 4 illustrates a printing device according to one exemplary embodiment.

FIG. 4 illustrates a schematic representation of an off-axis printing device (400). When in operation, a print head (410) is coupled to the ink delivery apparatus (100). The print head (410) selectively ejects drops of ink (420) onto a print medium (430) according to print job data to form desired text and/or images on the print medium (430). The printing medium (430) is moved laterally with respect to the print head (410) by, for example, two driven rollers (440, 450).

The print head (410) is moved back and forth across the print medium (430) by, for example, a drive belt (460) or other device.

The print head (410) contains a plurality of firing chambers that are energized on command by selectively firing resistors. Thus, as the print head moves laterally across the print medium (430) and the print medium (430) is moved by the rollers (440, 450), drops of ejected ink (420) form images and/or text on the printing medium (430).

Maintenance of the negative pressure within the pressure tuned rolling piston (110) within predetermined limits facilitates improved performance of the printing device (400) by reliably supplying ink to the print head (410) while preventing the print head (410) from drooling ink onto the print medium (430) due to such occurrences as temperature or altitude variations. Further, providing a pressure tuned rolling piston allows for smaller printing devices due to the volumetric efficiency of the pressure tuned rolling piston (110). Additionally, the relatively low part count associated with some implementations of the ink delivery apparatus (100; FIG. 1) may facilitate broader applications of printing devices. Further, a pressure tuned rolling piston allows for more complete evacuation of ink than with other systems. As a result, ink re-supply may occur less often, thereby increasing the uptime of the printing device (400) and decreasing the operating costs of the printing device (400).

The rolling piston (110) may be made of any material that allows it to be configured to at least partially collapse over a predetermined range of negative pressures while providing a predicted resistance to that collapse so as to maintain the negative pressure within a desired range. Such materials may include, but are in no way limited to elastomeric materials such as EPDM/Butyl (Ethylene Propylene Diene Monomer). In the illustrated implementations, the walls of the rolling piston may be of a constant thickness, such as 0.5 mm. The rolling piston may be fabricated by any suitable means, such as, for example, molding.

Alternative Embodiments

Figure 5:
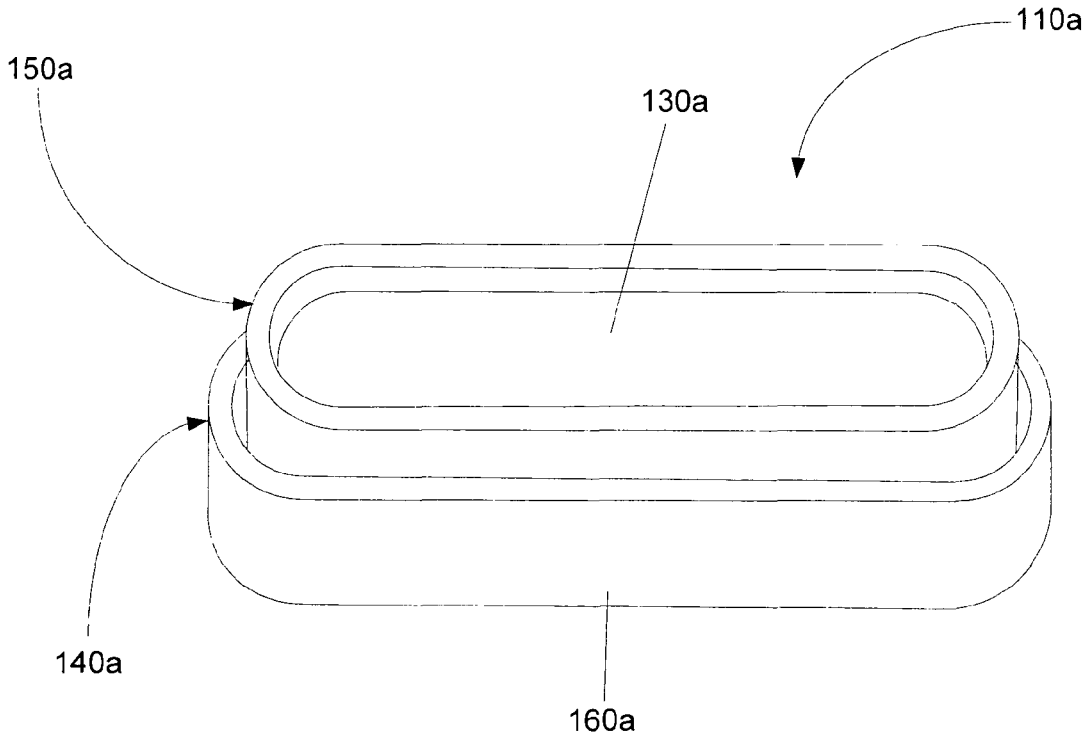
FIG. 5 illustrates a rolling piston according to one exemplary embodiment.

FIG. 5 illustrates a rolling piston (110*a*) in which the second convolute portion (150*a*) is more remote from the proximal end (160*a*) than the pressure responsive portion (130*a*). In other words, the second convolute portion (150*a*) extends above the pressure responsive portion (130*a*). Similarly, the aspect ratio of the second convolute portion (150*a*) is much smaller than the aspect ratio of the first convolute portion (140*a*). Accordingly, FIG. 5 illustrates how the rolling piston may be tuned to match the specific operating specifications of a printing device.

Figure 6:
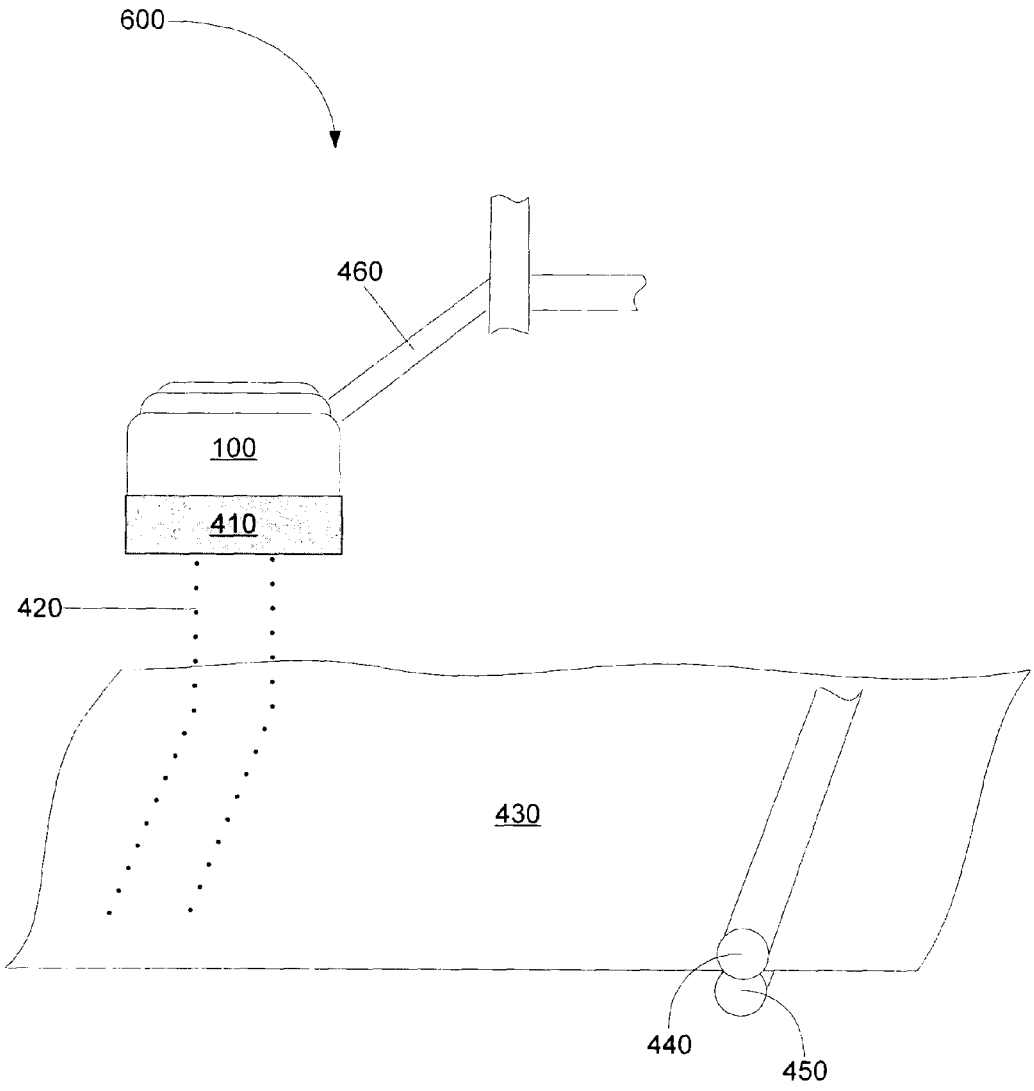
FIG. 6 illustrates a printing device according to one exemplary embodiment.

FIG. 6 illustrates an on-axis printing device (600). In an on-axis printing device, the ink supply travels with the print head. In such an embodiment, the ink delivery apparatus (100), described above, is coupled to a print head (410) to provide ink for the print head (410). In the illustrated configuration, the ink delivery apparatus (100) is directly coupled to a print head (410). In other on-axis printing embodiments, however, the ink delivery apparatus (100) may not be directly coupled to the print head (410). In all such systems, the volumetric efficiency of the rolling piston described above may allow for smaller print cartridges. In addition, the volumetric efficiency of the rolling piston may decrease overall operating costs by requiring less frequent ink refills while maintaining the back pressure within the desired range during operation.

In other embodiments, a plurality of pressure tuned rolling pistons may be utilized to contain a plurality of differently colored inks, with each of the colors being separated one from another. For example, each color of ink may be contained in a separate piston. Control of the negative pressure in the rolling pistons (e.g., 110) is accomplished as described above with the specific design and fabrication of the convolute portions of the piston. This facilitates improved performance of the printing device (400; FIG. 5) by reliably supplying ink to the print head (410) while preventing the print head (410) from drooling ink onto the print medium (430). Further, providing a plurality of rolling pistons (110) allows for smaller color printing devices due to the volumetric efficiency of each rolling piston (110). Smaller print cartridges may allow for a decrease in the overall size of printing devices and facilitate broader applications of printing devices.

Still other embodiments may utilize at least one rolling piston coupled to a page-wide array of inkjets. Further, the pressure tuned ink delivery apparatus (100; FIG. 1) may be configured for use in any system requiring control or regulation of negative or back pressures and/or containment of ink.

The preceding description has been presented only to illustrate and describe the present method and apparatus. It is not intended to be exhaustive or to limit the disclosure to any precise form disclosed. Many modifications and variations are possible in light of the above teaching. It is intended that the scope of the invention be defined by the following claims.

What is claimed is:

1. An ink delivery apparatus, comprising a pressure tuned rolling piston having a distal end having a pressure responsive portion;

a first convolute portion coupled to said pressure responsive portion, said first convolute portion being configured to provide a first level of resistance against a negative pressure in said piston; and a second convolute portion coupled to said first convolute portion, said second convolute portion being configured to provide further resistance against said negative pressure in said piston, and wherein when in a first condition at least a part of said second convolute portion surrounds at least a part of said first convolute portion.

2. The apparatus of claim 1, wherein said pressure tuned rolling piston comprises an elastomeric material.

3. The apparatus of claim 2, wherein said elastomeric material comprises EPDM/Butyl.

4. The apparatus of claim 3, wherein said pressure tuned rolling piston comprises walls of substantially uniform thickness.

5. The apparatus of claim 1, wherein said pressure responsive portion comprises a generally planar portion.

6. The apparatus of claim 1, further comprising a fitment coupled to a proximal end of said piston.

7. The apparatus of claim 6, wherein said fitment is configured to couple with a print head.

8. The apparatus of claim 6, wherein said fitment further comprises a fluid interconnect.

9. The apparatus of claim 8, wherein said fluid interconnect is configured to fluidly couple a printing device and said piston.

10. The apparatus of claim 9, wherein said piston provides an off-axis ink supply.

11. The apparatus of claim 9, wherein said piston provides an on-axis ink supply.

12. The apparatus of claim 1, wherein said first convolute portion is configured to expand or contract based on ambient conditions.

13. An ink delivery apparatus, comprising a pressure tuned rolling piston having a distal end having a pressure responsive portion;

a first convolute portion coupled to said pressure responsive portion; and a second convolute portion coupled to said first convolute portion;

wherein a perimeter of said second convolute portion is larger than a perimeter of said first convolute portion and wherein when in a first condition at least a part of said second convolute portion surrounds at least a part of said first convolute portion.

14. The apparatus of claim 13, wherein said first and second convolute portions are configured to provide first and second levels of resistance against a negative pressure in said piston.

15. The apparatus of claim 13, wherein said second convolute member supports said first convolute member.

16. The apparatus of claim 13, wherein said pressure responsive portion is disposed inside said first convolute portion.

17. The apparatus of claim 13, wherein said pressure responsive portion is disposed above said first convolute portion.

18. An ink delivery assembly, comprising:

at least one pressure tuned rolling piston having a distal end having a pressure responsive portion;

a first convolute portion supporting said pressure responsive portion, wherein said first convolute portion is configured to provide a first level of resistance against a negative pressure in said piston;

a second convolute portion adjacent said first convolute portion, wherein said second convolute portion is configured to provide further resistance against said negative pressure in said piston, and wherein when in an first condition at least a part of said second convolute portion surrounds at least a part of said first convolute portion;

a proximal end opposite said distal end; and a fitment coupled to said proximal end of said pressure tuned rolling piston.

19. The assembly of claim 18, wherein a perimeter of said second convolute portion is larger than a perimeter of said first convolute portion.

20. The assembly of claim 19, wherein said first convolute portion extends above said pressure responsive portion.

21. The assembly of claim 18, wherein said first convolute portion includes a first aspect ratio and said second convolute portion includes a second aspect ratio, and wherein said first aspect ratio is larger than said second aspect ratio.

22. The assembly of claim 21, wherein said first and second aspect ratios are selected based on predetermined operational specifications of a printing device.

23. The assembly of claim 18, wherein said fitment further comprises a fluid interconnect.

* * * * *